United States Patent [19]

DiMille et al.

[11] 4,134,599

[45] Jan. 16, 1979

[54] RUNNERLESS ROLLER SLED

[76] Inventors: Dante DiMille, 501A Surf Ave., Brooklyn, N.Y. 11224; Edward Dredger, 2752 E. 22nd St.; Thomas Passantino, 26-42 E. 7th St., both of Brooklyn, N.Y. 11235

[21] Appl. No.: 871,223

[22] Filed: Jan. 23, 1978

[51] Int. Cl.[2] ..... B62B 11/00

[52] U.S. Cl. ..... 280/87.01; 188/29; 188/72.7

[58] Field of Search ..... 280/87.01, 87.02 R, 280/87.03, 87.04 A, 8; 188/16, 17, 29, 1 D, 72.7

[56] References Cited

U.S. PATENT DOCUMENTS

| | | | |
|---|---|---|---|
| 2,219,905 | 10/1940 | Prickman | 280/87.01 X |
| 3,226,130 | 12/1965 | Smith | 280/87.01 X |
| 3,391,947 | 7/1968 | Hodas | 280/87.01 X |
| 3,870,334 | 3/1975 | Cole | 280/87.01 |
| 4,046,392 | 9/1977 | Dredger | 280/8 |

*Primary Examiner*—John A. Pekar

*Attorney, Agent, or Firm*—Brumbaugh, Graves, Donohue & Raymond

[57] ABSTRACT

An improved runnerless roller sled comprises a bed; a longitudinal, laterally flexible support member discontinuously attached to the bed beneath the bed center line; a front pair and a rear pair of roller wheels attached to the front and rear sections, respectively, of the support member; a steering bar attached to the front section of the support member; and a pair of braking means for separately or simultaneously braking the rear pair of roller wheels and comprising pairs of brake levers, brake rods, brake rocker arms and brake shoes.

9 Claims, 7 Drawing Figures

RUNNERLESS ROLLER SLED

The present invention relates to an improved runnerless roller sled.

Sleds having runners have been enjoyed for decades by the young and old alike. However, such sleds can only be used in the winter time and then only in those areas of the country lying within the snow belt.

In order to extend the enjoyability and utility of sleds with runners to those areas of the country which do not have snow even in the winter and to those seasons of the year when there is no snow on the ground, it has been proposed heretofore to provide such sleds with roller wheels which are detachably mounted to each runner by clamping means at the forward flexible section of the runner and at the rearward nonflexible section of the runner. One such highly satisfactory roller sled is described in U.S. Pat. No. 4,046,392.

It has also been proposed heretofore to provide runnerless roller sleds, i.e., sled without runners and having roller wheels directly mounted onto the sled bed. However, those runnerless roller sleds which have been proposed heretofore have complicated steering mechanisms and/or braking mechanisms which make them expensive to manufacture and subject to parts failure. Such sleds are also aesthetically unattractive and hence lacking in sales appeal.

Accordingly, it is the principal object of the present invention to provide an aesthetically appealing runnerless roller sled having an improved simplified steering mechanism and an improved braking mechanism.

The runnerless roller sled of the invention comprises, in general, a bed; a longitudinal, laterally flexible support member discontinuously attached to the bed beneath the bed center line; a front pair and a rear pair of roller wheels attached to the front and rear sections, respectively, of the support member; a steering bar attached to the front section of the support member; and a pair of braking means for separately or simultaneously braking the rear pair of roller wheels and comprising pairs of brake levers, brake rods, brake rocker arms and brake shoes.

The invention will be described in greater detail in connection with the accompanying drawings wherein.

Figure 1:
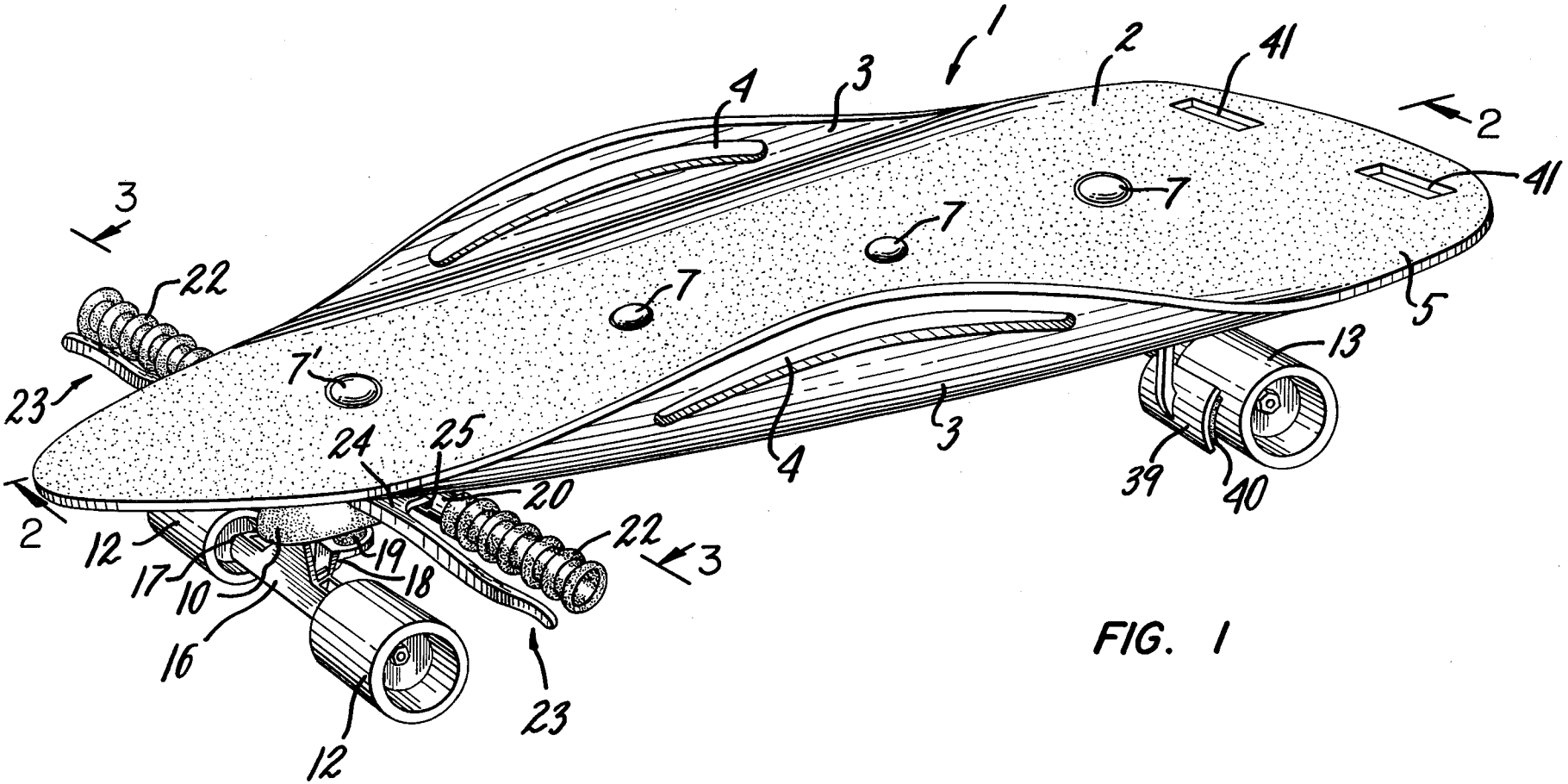
FIG. 1 is a perspective view of the runnerless roller sled.
Figure 2:
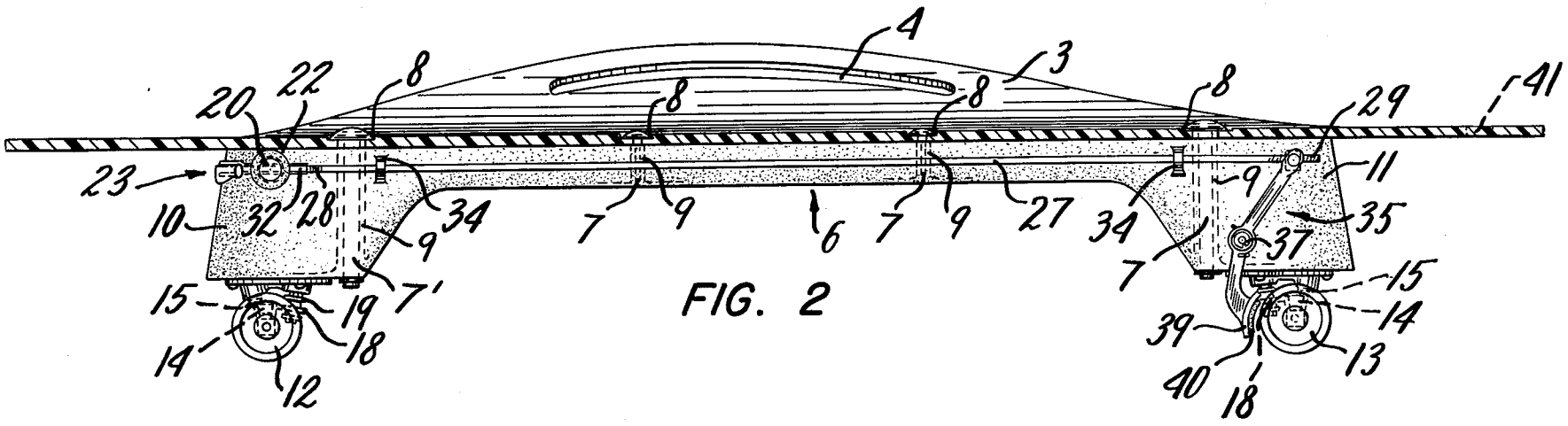
FIG. 2 is a side elevational view of the runnerless roller sled with the bed of the sled in longitudinal section taken on section line 2—2 in FIG. 1.
Figure 3:
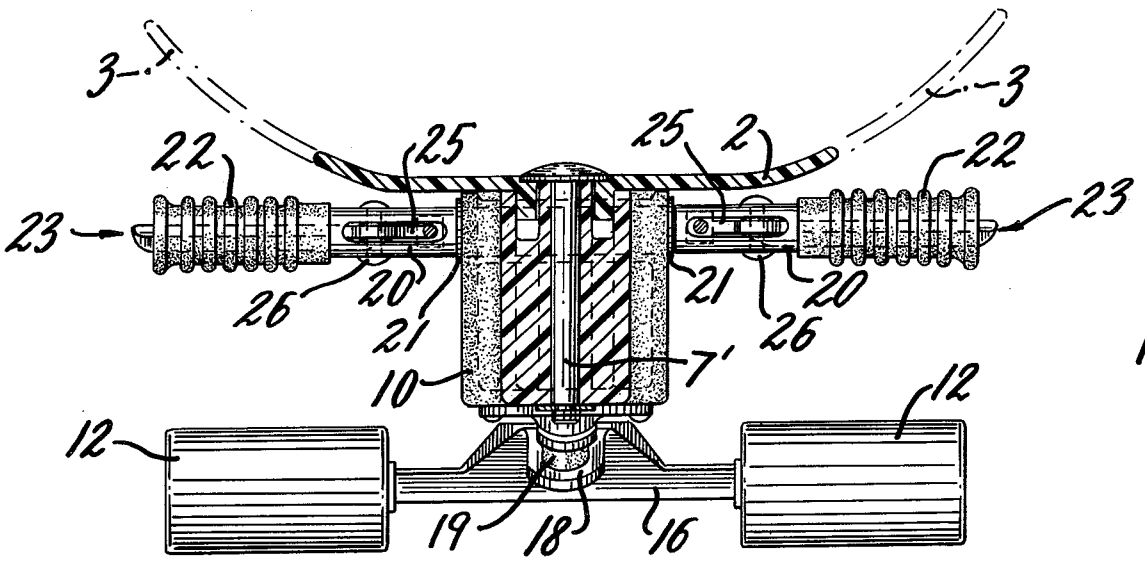
FIG. 3 is a transverse sectional view taken on section line 3—3 in FIG. 1.
Figure 4:
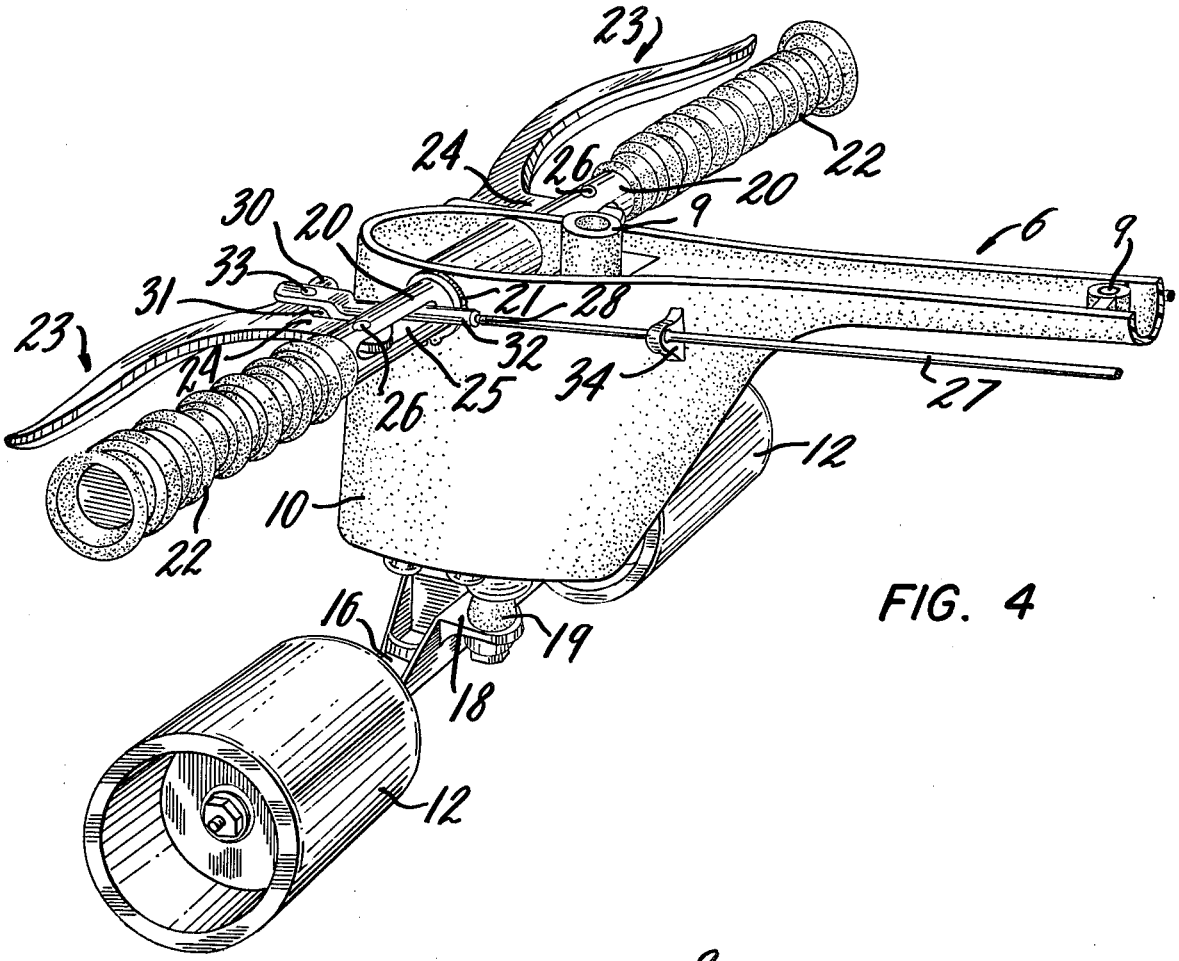
FIG. 4 is a perspective view of the front portion of the runnerless roller sled with the bed removed.
Figure 5:
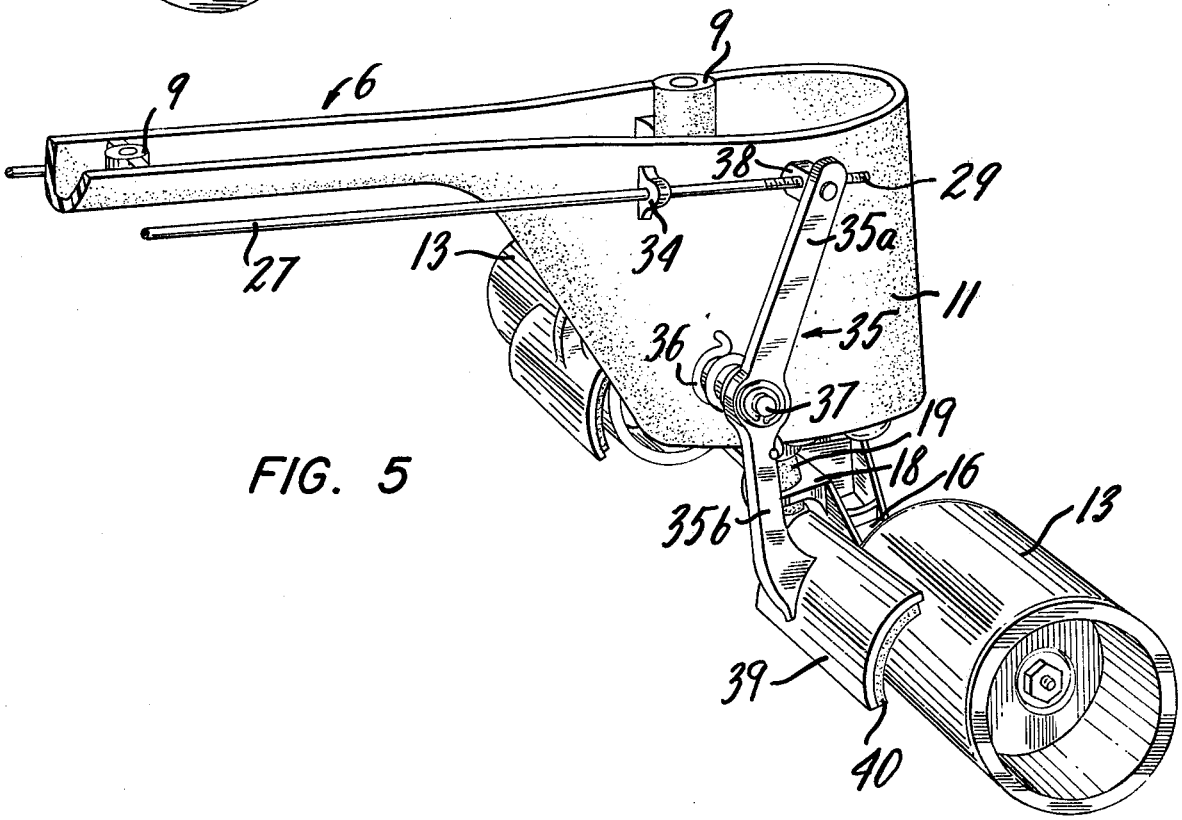
FIG. 5 is a perspective view of the rear portion of the runnerless roller sled with the bed removed and showing one embodiment of the braking mechanism.

Referring to FIGS. 1–6 of the drawing, the runnerless roller sled 1 has a streamline bullet-nosed bed 2 made of a suitable lightweight material, such as, aluminum or a fiber glass reinforced molded plastic of adequate impact strength, e.g., polypropylene. The bed 2 has an upwardly turned member 3 along each side with a horizontal slot 4 therein which serves as means for gripping the sled 1, particularly while in the act of "belly whopping." The two upwardly turned side members 3 also serve to keep the user's body on the sled 1 during sharp turns by cradling the body so as to counteract the centrifugal force acting on the user's body. The upper surface of the bed 2 has an all weather nonslip or friction coating 5 thereon which further serves to keep the user's body in position on the sled 1 during sharp turns and thereby avoid being thrown off the sled 1 and causing abrasion or other bodily injury.

A longitudinal, laterally flexible channel-shaped support member 6 made of a material having suitable impact and flex strength, such as polypropylene, is discontinuously attached to the bed 2 beneath the bed center line by a plurality of spaced pins 7 which can take the form of rivets, threaded bolts and nuts, and the like. These pins 7 pass through recessed cylindrical holes 8 in the bed 2 which are in registration with cylindrical collars 9 spaced along the support member 6. The forward pin 7′ serves as a pivot pin or fulcrum in steering the sled 1 as discussed hereinafter. The support member 6 also has an enlarged front section 10 and an enlarged rear section 11.

A front pair of roller wheels 12 is attached transversely to and beneath the front section 10 and a rear pair of roller wheels 13 is attached transversely to and beneath the rear section 11. Each pair of roller wheels 12 and 13 has means for pivoting the roller wheels and means for dampening the pivotal means. Thus, a pivot member 14 is pivotally mounted at its upper end in a cup or socket 15 attached to either the front section 10 or the rear section 11. The pivot member 14 is connected at its lower end to an axle housing 16. An axle 17 for the roller wheels 12 and 13 passes through the axle housing 16 and a dampener arm 18 extends either rearwardly or forwardly from the axle housing 16. A kingpin (not shown) is surrounded by a rubber bushing or dampener 19 and joins the dampener arm 18 to either the front section 10 or the rear section 11. Such dampened pivotal roller wheels 12 and 13 render the runnerless roller sled 1 easier to steer, since they operate in the same fashion as the roller wheels for the now popular skate boards.

A steering bar 20 passes through and is attached transversely to the front section 10 of the support member 6 via locking rings 21 and is positioned forward and the pivot pin or fulcrum 7′. The steering bar 20 has handle grips 22 at each end.

A pair of brake levers 23 is mounted on the steering bar 20, one forward of each handle grip 22. Thus, each brake lever 23 has an arm 24 which extends into a slot 25 of the steering bar 20 and is held in place by a pivot pin 26.

A brake rod 27 having front end threads 28 and rear end threades 29 is adjustably connected to each of the brake levers 23 via an arm 30 of the brake lever 23 which arm 30 fits into a slot 31 of the bifurcated and threaded brake rod extension 32 and is held in place by a pivot pin 33. Each brake rod 27 is slidably mounted in eyelet fittings 34 along a lateral face of the front section 10 and the rear section 11 of the support member 6.

A brake rocker arm 35, which is spring-loaded via a coil spring 36, is pivotally mounted on a lateral face of the rear section 11 of the support member 6 via a pivot pin 37. Each spring-loaded brake rocker arm 35 is adjustably connected to a brake rod 27 via the rear end threads 29 on the brake rod 27 which engage a threaded angular extension 38 of the upper arm 35*a* of the rocker arm 35.

A curvilinear brake shoe 39 having a friction lining 40 is operatively connected to or directly mounted on the lower arm 35*b* of each brake rocker arm 35 and is engageable via the friction lining 40 with the rolling surface or cylindrical face of one of the rear roller wheels 13.

The tension on the brake levers 23 can be adjusted by turning the threaded brake rods 27 inward or outward of the threaded brake rod extensions 32 and/or the threaded angular extension 38 of the rocker arm 35 so as to increase or decrease the pressure applied by the coil spring 36. Alternatively, the adjustability can be achieved by forming the brake rod 27 into two threaded sections connected together by a turnbuckle.

The sled bed 2 can be reinforced by arms or braces (not shown) extending transversely from the support member 6.

The roller sled 1, when in motion, can be slowed down or stopped by squeezing both brake levers 23 toward the two handle grips 22. Such squeezing of both brake levers 23 causes each brake lever 23 to pivot about the two pivot pins 26 and 33 which in turn causes the brake rod 27 to be pulled forward and the brake shoes 39 to be forced rearward into frictional engagement with the rear roller wheels 13.

The use of a separate braking mechanism for each rear roller wheel 13 also enables the user of the roller sled 1 to turn the sled 1 merely by braking or slowing only one rear wheel 13 and without turning the steering bar 20, because such braking action causes the sled 1 to turn in the direction of the rear roller wheel 13 which is being braked or slowed down. The roller sled 1 is also capable of being turned in one direction or the other without turning the steering bar 20 by the user shifting his body weight to one side of the sled bed 2, which weight shift causes the roller wheels 12 and 13 to pivot about their above-described pivot means.

Figure 6:
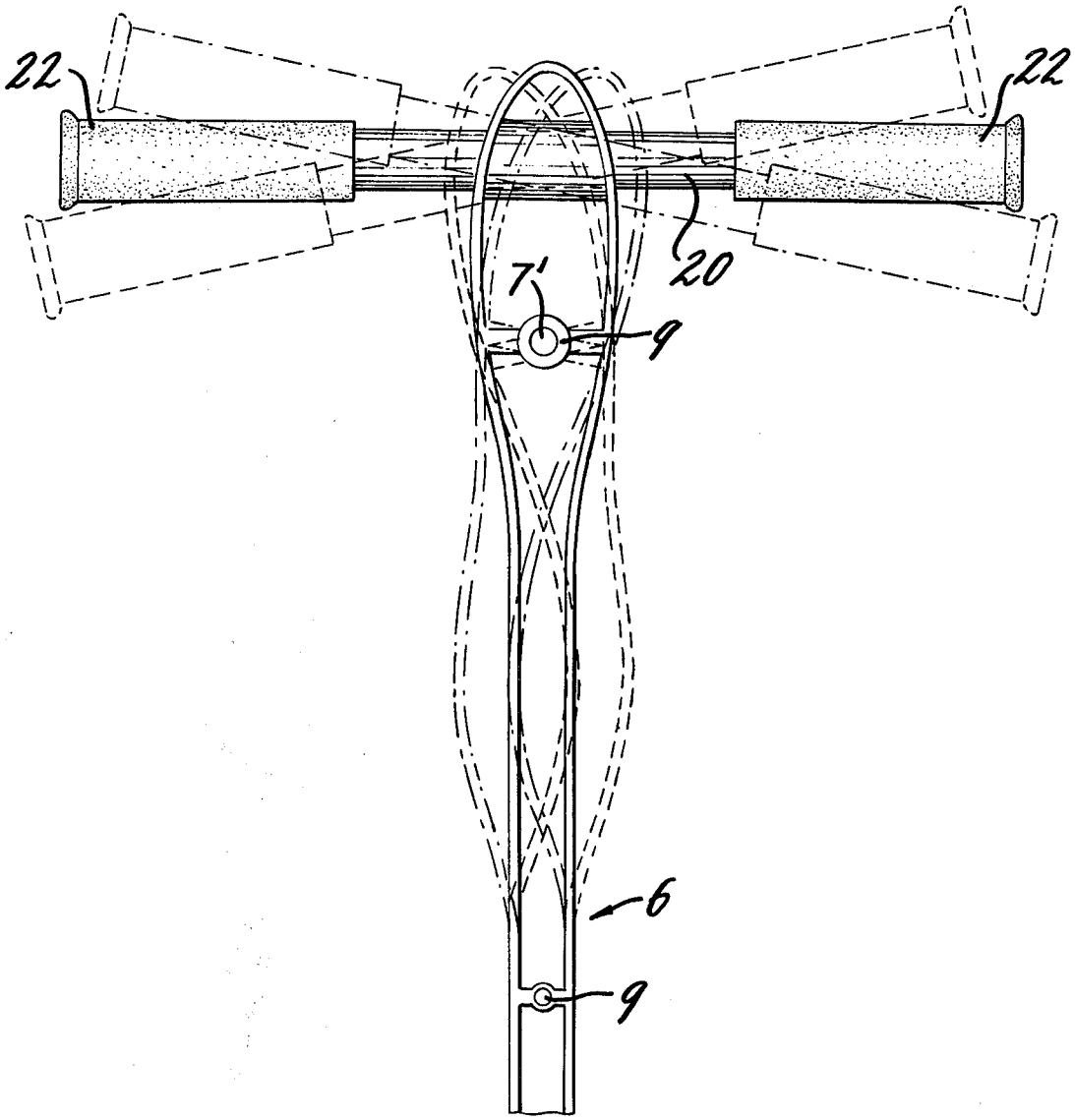
FIG. 6 is a diagrammatic top plan view of three different steering positions of the steering mechanism for the runnerless roller sled.

However, the principal means for steering the roller sled 1 is the cooperation between the steering bar 20 and the flexible support member 6 as diagrammed in FIG. 6. Thus, when the steering bar 20 is in its normal transverse position (as shown in solid lines in FIG. 6), the flexible support member 6 is also in its normal longitudinal position (as also shown in solid lines in FIG. 6) so that the roller sled 1 will move in a straight line, provided there is no turning effect due to either braking or shift in the user's body weight. When the lefthand handle grip 22 of the steering bar 20 is pulled rearward and the righthand handle grip 22 of the steering bar 20 is pushed forward (as shown in dashed lines in FIG. 6), the flexible support member 6 flexes laterally about the pivot pin or fulcrum 7' (as also shown in dashed lines in FIG. 6) which causes the attached front pair of roller wheels 12 to be turned to the left so that the roller sled 1 is steered to the left. On the other hand, when the righthand handle grip 22 of the steering bar 20 is pulled rearward and the lefthand handle grip 22 of the steering bar 20 is pushed forward (as shown in dot-dash lines in FIG. 6), the flexible support member 6 flexes laterally about the pivot pin or fulcrum 7' (as also shown in dot-dash lines in FIG. 6) which causes the attached front pair of roller wheels 12 to be turned to the right so that the roller sled 1 is steered to the right.

Indeed, the high degree of steering control which can be achieved by the cooperative and simultaneous action of the roller wheel pivot means, the two separate braking means and the steering means enables a skilled user of the roller sled to make the sled follow any tricky or irregular path, such as gymkhana course. Such trick roller sled riding can be achieved in safety without the user being thrown off the roller sled, because the friction coating on the upper surface of the sled bed and the upwardly turned side members assist in keeping and cradling the user's body on the sled bed. A further safety feature for retaining the user's body on the sled bed, particularly during sharp turns, is the provision of stirrups in the form of two transverse slots 41, one for each foot, at the rear of the sled bed 2.

Figure 7:
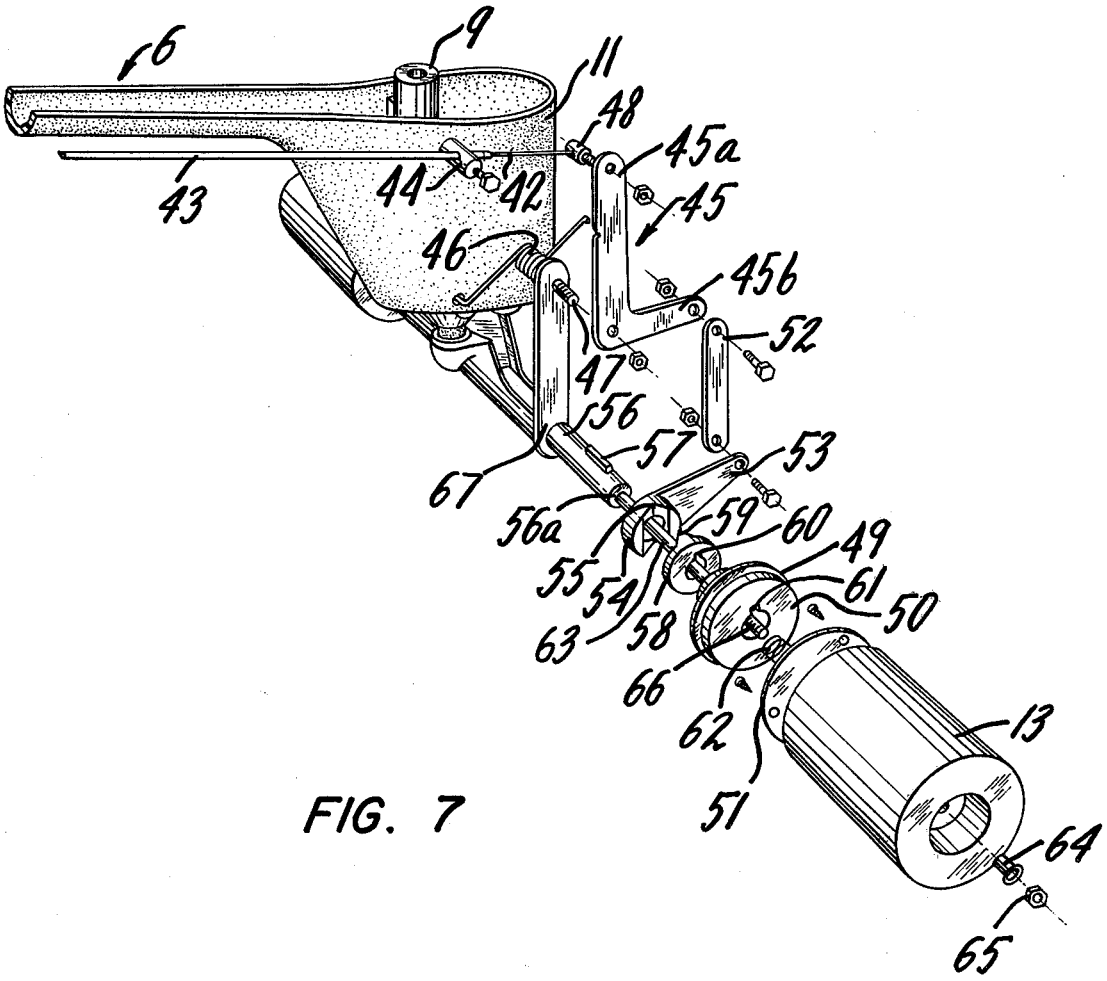
FIG. 7 is an exploded perspective view of the rear portion of the runnerless roller sled with the bed removed and showing another embodiment of the braking mechanism.

Referring now to FIG. 7 of the drawings, this shows another and improved embodiment of the braking mechanism which is not subject to loss in efficiency due to the eventual accumulation in prolonged use of foreign matter, such as dirt, on the rolling surface or cylindrical face of the rear roller wheels 13 which causes slippage and scoring of the friction lining 40 on the brake shoe 39. In this improved embodiment, the brake rod is a wire cable 42 which is connected at one end to the above-mentioned brake lever 23 and which is slidably mounted within a sleeve 43 along a lateral face of the above-mentioned front section 10 and the rear section 11 of the support member 6 via fittings 44. A right angle or L-shaped brake rocker arm 45, which is spring-loaded via a coil spring 46, is pivotally mounted on a lateral face of the rear section 11 of the support member 6 via a pivot pin 47. The spring-loaded brake rocker arm 45 is connected from its vertical upper arm 45*a* to the wire cable brake rod 42 via a connector 48.

A disc brake shoe 49 having a friction lining 50 is operatively connected (as discussed below) to a horizontal lower arm 45*b* of the brake rocker arm 45 and is engageable via the friction lining 50 with a circular plate 51 attached to the inner end of one of the rear roller wheels 13.

The horizontal lower arm 45*b* of the brake rocker arm 45 is connected to a vertical link 52, which link 52 is connected to an arm 53 of a female cam 54 having a V-shaped diametrical groove 55 in its outer face. The female cam 54 is freely rotatable on a transverse shaft 56 having a lengthwise key 57 thereon. A male cam 58 has a V-shaped diametrical rib 59 on its inner face which meshes with the V-shaped diametrical groove 55 of the female cam 54. The male cam 58 has a keyway 60 which rides axially along the key 57 on the shaft 56. The disc brake shoe 49 has a keyway 61 which also rides axially along the key 57 on the shaft 56. A compression spring 62 encircling an axle 63 abuts against the face 56*a* of the shaft 56 and also abuts against the circular plate 51. The rear roller wheel 13 is freely rotatable on axle 63 and is held thereon via washer 64 and nut 65 which is threaded onto threads 66 at the end of the axle 63. A strut 67 is mounted between the pivot pin 47 and the shaft 56 in order to strengthen and support the improved braking mechanism.

The above-described improved braking mechanism is located on each side of the support member 6 and operates in the following manner. The braking mechanism is actuated by squeezing the brake lever 23 which causes the wire cable brake rod 42 to move forward. The forward motion of the wire cable brake rod 42 causes the brake rocker arm 45 to pivot counterclockwise on the pivot pin 47 and store energy in the coil spring 46. The pivoting of the brake rocker arm 45 moves the link 52 upwardly which causes the female cam 54 to rotate counterclockwise on the shaft 56. Since the male cam 58 is unable to rotate due to engagement of its keyway 60 with the key 57 on the shaft 56 and further since the abuting disc brake shoe 49 is also unable to rotate due to engagement of its keyway 61 with the key 57 on the shaft 56, the counterclockwise rotation of the female cam 54 causes the rib 59 on the male cam 58 to ride outwardly along the walls of the groove 55 in the female cam 54. This riding action slides the male cam 58 and the abuting disc brake shoe 49 axially outward along the key 57 whereupon the spring 62 is compressed to store energy and the friction lining 50 engages the circular plate 51 attached to the rear roller wheel 13 and slows or stops the rear roller wheel 13.

When the brake lever 23 is released, the energy stored in the springs 46 and 62 causes the above brake elements to move in the reverse direction and disengages the friction lining 50 from the circular plate 51 thus allowing the rear roller wheel 13 to rotate freely on the axle 63.

From the foregoing description and drawings, it is clear that the runnerless roller sled of the invention is aesthetically appealing and provides a highly effective simplified steering mechanism and braking mechanism which have not been obtainable by the heretofore proposed runnerless roller sleds. Moreover, the runnerless roller sled of the invention provides a degree of safety to the user which has not been obtainable by the heretofore proposed runnerless roller sleds due to the cooperation between the dual braking means, the friction-coated bed and body-cradling side members of the bed. The runnerless roller sled, therefore, provides enjoyment with safety for the user, whether a child or an adult, on flat or inclined paved surfaces all year around.

What is claimed is:

1. A runnerless roller sled which comprises:

a bed having a center line;

a longitudinal, laterally flexible support member discontinuously attached to said bed beneath said center line by a plurality of spaced pins, the forwardmost pin being a pivot pin, said support member having a front and rear section;

a front pair of roller wheels attached transversely to and beneath said front section;

a rear pair of roller wheels attached transversely to and beneath said rear section;

a steering bar attached transversely to said front section forward of said pivot pin and having handle grips at each end;

a pair of brake levers mounted on said steering bar, one forward of each handle grip;

a pair of brake rods, one each connected to one of said brake levers and slidably mounted along a lateral face of said support member;

a pair of spring-loaded brake rocker arms, one each pivotally mounted on a lateral face of said rear section of said support member and connected to one of said brake rods; and a pair of brake shoes, one operatively connected to each brake rocker arm and engageable with one of said rear roller wheels.

2. The runnerless roller sled as defined by claim 1 wherein said bed has an upwardly turned slotted hand grip member along each side.

3. The runnerless roller sled as defined by claim 1 wherein said bed has stirrups at a rear portion thereof.

4. The runnerless roller sled as defined by claim 1 wherein said brake levers are adjustably connected to said brake rods.

5. The runnerless roller sled as defined by claim 1 wherein said spring-loaded brake rocker arms are adjustably connected to said brake rods.

6. The runnerless roller sled as defined by claim 1 wherein each pair of roller wheels has means for pivoting the roller wheels and means for dampening said pivotal means.

7. The runnerless roller sled as defined by claim 1 wherein said bed has an upper surface with a friction coating thereon.

8. The runnerless roller sled as defined by claim 1 wherein each brake shoe is curvilinear and has a friction lining engageable with a rolling surface of one of said rear roller wheels.

9. The runnerless roller sled as defined by claim 1 wherein each brake shoe is a disc having a friction lining engageable with a circular plate attached to an inner end of one of said rear roller wheels.

* * * * *